US005219020A

United States Patent [19]

Akachi

[11] Patent Number: 5,219,020

[45] Date of Patent: Jun. 15, 1993

[54] STRUCTURE OF MICRO-HEAT PIPE

[75] Inventor: Hisateru Akachi, Sagamihara, Japan

[73] Assignee: Actronics Kabushiki Kaisha, Isehara, Japan

[21] Appl. No.: 745,555

[22] Filed: Aug. 15, 1991

[30] Foreign Application Priority Data

Nov. 22, 1990 [JP] Japan ..... 2-319461
Jan. 9, 1991 [JP] Japan ..... 3-61385

[51] Int. Cl.[5] ..... F28D 15/02

[52] U.S. Cl. ..... 165/104.26; 165/104.14; 165/104.29

[58] Field of Search ..... 165/104.22, 104.14, 165/104.26, 104.29

[56] References Cited

U.S. PATENT DOCUMENTS 4,222,436 9/1980 Pravda ..... 165/104.21
4,883,116 11/1989 Seidenberg et al. ..... 165/104.26
4,921,041 5/1990 Akachi ..... 165/104.29

FOREIGN PATENT DOCUMENTS 2330965 6/1977 France .
2407445 5/1979 France .
2554571 5/1985 France .
55-152393 11/1980 Japan .
252892 4/1987 Japan ..... 165/104.22
49699 3/1988 Japan ..... 165/104.22
2006950 5/1979 United Kingdom .
2226125 6/1990 United Kingdom .

*Primary Examiner*—Albert W. Davis, Jr.
*Attorney, Agent, or Firm*—Bachman & LaPointe

[57] ABSTRACT

A structure of a heat pipe applicable to a heat transportation device is disclosed in which an elongate metallic capillary tube is formed having an inner diaeter sufficiently small to enable movement of a bi-phase compressible working fluid having a predetrmined quantity and sealed into the metallic capillary container in a filled and closed state, a plurality of heat receiving portions and heat radiating portions being on predetermined parts of the elongate metallic tube and alternatingly arranged thereat. Both terminals of the metallic elongate capillary tube are heretically sealed thereat or hermetically connected to form a loop-type flow passage of the bi-phase compressible working fluid. In addition, no flow direction limiting mechanism such as check valves is essentially eliminated.

15 Claims, 6 Drawing Sheets

STRUCTURE OF MICRO-HEAT PIPE

BACKGROUND OF THE INVENTION (1) Field of the Invention

The present invention relates generally to a structure of a heat pipe, and more particularly to the structure of the heat pipe which can be provided with small-sized, light-weighted, heat receiving and heat radiating apparatuses for the heat pipe and can achieve a very long heat pipe of continuous capillary dimension having very narrow inner and outer diameters which could not conventionally be manufactured.

(2) Description of the Background Art

Recently manufactured metallic capillary heat pipes tend to have a performance changed remarkably according to a mounting posture thereof. Particularly, it is almost impossible to operate the capillary heat pipe mounted under a top heat situation, i.e., under a state where a water level of a heat receiving portion of the heat pipe is higher than that of the heat radiating portion.

Since, in operation, a vapor stream of a working liquid which moves from a vapor portion to a condensating portion at high speeds and a stream of condensated liquid which circulates from the condensating portion to the vaporizing portion are mutually in opposite directions, their mutual interference make the cause difficulty in utilizing a smaller or fine heat pipe dimension. Therefore, there is a limit of manufacturing a fine capillary heat pipe having an outer diameter of approximately 3 mm and a length of approximately 400 mm. As a matter of fact, in the capillary heat pipe generally referred to as a micro-heat pipe, the length of merely several to 10 mm is the limit of manufacturing the heat pipe.

It is impossible to bend the loop portion of a loop-type heat pipe and, a degree of freedom in use is problematically small.

U.S. Pat. No. 4,921,041 issued on May 1, 1990 and Japanese Patent Application First publication No. Showa 63-31849 published on Dec. 27, 1988 exemplify previously proposed heat pipe structures which solve the above-described problems.

One of typical previously proposed capillary heat pipe structures (refer to FIG. 2) includes: a continuous elongate tube (2) of continuous capillary dimension having both ends thereof air-tightly connected to each other to form a continous capillary loop-type flow passage; a heat carrying fluid within the elongate tube in a predetermined amount sufficient to allow flow to the fluid through the loop flow passage in a closed state defined by the elongate tube; at least one heat receiving portion (2-H) located on a second part of the elongate tube for heating the fluid therein; at least one heat radiating portion (2-C) located on a second part of the elongate tube for cooling the fluid therein; and flow control means (3) located within the loop-type flow passage for limiting flow of the heat carrying fluid to a single direction in the flow passage. Especially, a bi-phase condensative working liquid (4) is filled in the container as a heat carrying fluid. It is noted that an inner diameter of the capillary tube is smaller than a maximum of the inner diameter which could circulate or travel with the working fluid always closed in the tube due to the presence of a surface tension of the tube.

The flow control means is constituted by at least one check valve (3).

In the structure of the loop-type heat pipe described above, external heating means (H) is provided to heat the heat receiving portion (2-H) while the heat radiating means (C) is externally provided to cool the heat radiating portion (2-C). At this time, the check valve serves to separate the loop-type container into a plurality of pressure chambers in which a nucleate boiling (5) generated within the heat receiving portion causes a vibrative pressure difference and an inspiring action to be generated between the plurlity of pressure chambers formed by means of the check valve(s). The nucleate boiling within the heat receiving portion serves to propagate a pressure wave in the fluid, the pressure wave causing a valve body to be vibrated. Mutual actions between the vibration of the check valve body and inspiring action integrally generate a strong circulation propelling force on the working fluid.

In the way described above, the bi-phase working fluid in itself circulates in the predetermined direction within the loop. The nucleate boiling is not continuous. Thus, the circulating working fluid (4) circulates with its vapor bubbles (5) and working fluid (4) (closed liquid droplets) alternatingly arranged. Hence, heat transportation occurs due to a latent heat by heat transfer of the working fluid and sensible heat of the vapor bubbles (5).

The heat transportation due to the circulation stream of the working fluid makes possible an excellent heat transportation capability, irrespective of mounting posture of the heat pipe. In addition, since the heat pipe has a capillary dimension, the small-sized and light-weighted heat pipe can be achieved. Since it is possible to use the heat pipe in the free bending form, the degree of freedom of using the heat pipe can remarkably be enlarged.

However, the previously proposed heat pipe structure has yet various problems to be solved although the excellent performance is exhibited irrespective of the mounting posture in use and the heat pipe (refer to FIG. 2) can freely be flexed.

The problems yet to be solved are to promote further miniaturization of the diameter of the heat pipe in a micrometer range and reduction in weight of the heat transporting apparatuses and heat receiving and heat radiating apparatuses to meet demands by the technological field of the heat pipe.

In more detail, the problems yet to be solved are listed below:

a) If a thinner diameter of the heat pipe container is put into practice with the inner diameter of about 1.2 mm as a boundary, a failure rate of product (inverse of yield of the product) is abruptly increased and reliability is remarkably reduced. In a case where the check-valve equipped loop-type heat pipe is manufactured, the check valve has a very small dimension so that a quality control of the heat pipe during its manufacture cannot be assured.

A plurality of junctures are required for manufacturing the actual loop-type heat pipe disclosed in U.S. Pat. No. 4,921,041. As shown in FIG. 3, the required junctures are such as junctures (3-1, 3-2, 3-3) for mounting the check valve(s), junctures (8) for the connection of each heat pipe portion to form the loop, junctures (9) for injection of the working fluid into the inner portion of the capillary tube (2), and gas exhaust junctures (10) for the capillary tube. Welding operations for the respective junctures are carried out during manufacture.

For example, the junctures (3-1, 3-2, 3-3, and 8) need to be welded at their two parts, the junctures (9, 10) need to be welded at their four parts. Therefore, an abrupt difficulty in the welding operations occurs in heat pipes having an outer diameter less than 1.6 mm and inner diameter less than 1.2 mm. Consequently, the reliability of the product becomes reduced.

b) It is difficult to guarantee a long term reliability for a large thermal input at high temperatures even if a ruby-made ball is used as a valve body of each check valve. During a reliability test of a heat radiator requiring impulsively the thermal input of 5 KW at 300° C., such an accident as the destruction of the ruby-made ball has happened. Then, the ruby-made ball was replaced with a tungsten carbide ball and the reliability test was performed. Since the relative weight was as large as 13, the operation at the time of low thermal input was worsened. In addition, due to too much relative weight, a floating operation became difficult and the impulse of opening and closing the valve was generated. This indicated that the long term reliability was not guaranteed.

c) A limit of selection of a metallic material for the capillary container is present in order to guarantee the long term reliability of the check valve.

The reliability test for the check valve equipped loop-type heat pipe indicated that, according to a metallic material used for the internal surface of the capillary tube, an intergrunular corrosion occurred in metallic crystallines of the inner surface of the metallic capillary tube and multiple quantities of metallic powders were freed and deposited on each check valve, whereby heat transport operation was prevented d) If a floating type of check valve is used as disclosed in the U.S. Pat. No. 4,921,041 in order to elongate the life guarantee period, a reaction force, due to leakage loss in the check valves, is so weak that a water level difference between the heat receiving and heat radiating portions is limited to about 1000 mm by which the heat pipe is used in the top heat mode.

SUMMARY OF THE INVENTION

It is a main object of the present invention to provide a structure of a micro-heat pipe which solves the above-described problems, exhibiting excellent advantages over heat pipes disclosed in the U.S. Pat. No. 4,921,041, which enables remarkable small sizing and reduction of weights of attached heat receiving and heat radiating apparatuses and which achieves manufacture of the heat pipe with a micrometer-order capillary tube diameter dimension which would be conventionally difficult to be fabricated (low yield).

The above-described object can be achieved by providing a structure of a heat pipe, comprising: a) a metallic elongate tube of continuous capillary dimension; b) a predetermined bi-phase condensible working fluid having a predetermined quantity less than an internal volume of the metallic elongate tube, the metallic elongate tube having a small inner diameter sufficient for the bi-phase condensible working fluid to enable to move in the flow passage of the metallic elongate tube in a state always filled and closed in the metallic tube container due to surface tension; c) at least one heat receiving portion located on a first predetermined part of the metallic elongate tube; and d) at least one heat radiating portion located on a second predetermined part of the metallic elongate tube, both heat receiving portion and heat radiating portion being alternatingly disposed on the metallic tube.

The above-described object can also be achieved by providing a method of manufacturing a heat pipe comprising the steps of: a) disposing circulation flow direction limiting means in a predetermined part of a hermetically sealed metallic capillary tube, both terminals thereof being interconnected; b) providing at least one heat receiving portion on a first predetermined portion of the metallic capillary tube; c) providing at least one heat radiating portion on a second predetermined portion of the metallic capillary tube; d) sealing a predetermined bi-phase condensible working fluid into the loop-type metallic capillary tube by a predetermined quantity so that a mutual action between the circulation flow direction limiting means, nucleate boiling generated at the heat receiving portion, and a temperature difference between the heat receiving and heat radiating portions causes the bi-phase working fluid to flow in the flow passage of the loop-type metallic capillary tube in the direction limited by the circulation flow limiting means so as to make a thermal exchange between the heat receiving and radiating portions; and e) eliminating the circulation flow limiting means from the metallic capillary tube.

DETAILED DESCRIPTION OF THE PREFERRED EMBODIMENTS

Reference will hereinafter be made to the drawings and tables in order to facilitate a better understanding of the present invention.

Figure 2:
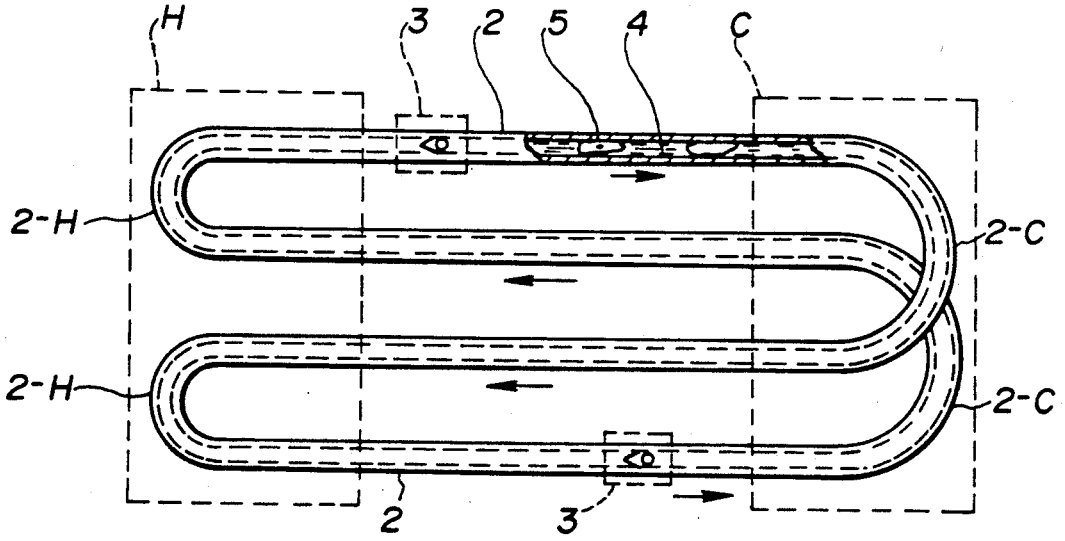
FIG. 2 is a partially sectioned elevational view of a prior art loop-type heat pipe as disclosed in the U.S. Pat. No. 4,921,041 in which an amount of heat is transported through a circulation of a working fluid.
Figure 3:
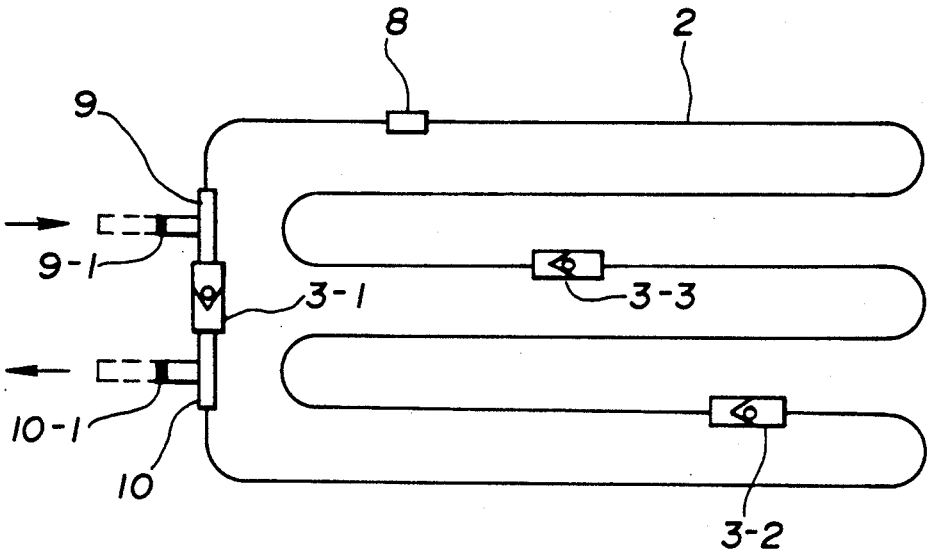
FIG. 3 is an explanatory view of welding portions for prior art junctures of the loop-type heat pipe in order to assemble the loop-type capillary container shown in FIG. 2.

It is noted that a structure and disadvantage of a previously proposed heat pipe has already been explained in the BACKGROUND OF THE INVENTION with reference to FIGS. 2 and 3.

First preferred embodiment

Figure 1:
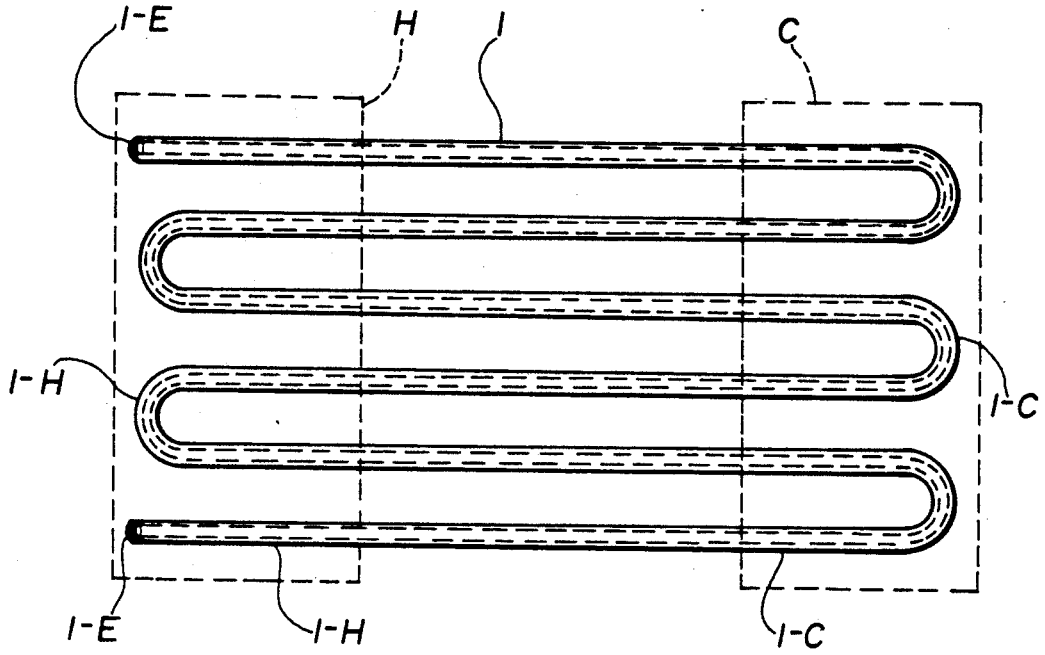
FIG. 1 is a schematic elevational view of a micro-heat pipe in a first preferred embodiment according to the present invention.

FIG. 1 shows a first preferred embodiment of a micro-heat pipe according to the present invention.

As shown in FIG. 1, a hermetically sealed capillary container 1 is constituted by an elongated metallic capillary tube having a sufficiently small inner diameter so as to enable a predetermined bi-phase condensible working fluid, vacuum sealed, to move through the container 1 in a closed state due to its surface tension. A plurality of predetermined portions of the container 1 are constituted by heat receiving portions 1-H and a plurality of other predetermined portions thereof are constituted by heat radiating portions 1-C. In addition, the heat radiating portions 1-C are located between the respective heat receiving portions 1-H. In FIG. 1, H denotes heat receiving means and C denotes heat radiating means. Both terminals 1-E of the capillary container 1 are welded and sealed after the predetermined quantity of the bi-phase condensible working fluid is sealed into the container 1.

In the micro-heat pipe shown in FIG. 1, a nucleate boiling generated at each heat receiving portion causes an axial directional vibration to be generated in the working fluid of part of the capillary container located between each heat receiving portion 1-H, the axial directional vibration moving a thermal quantity from each heat receiving portion to each heat radiating portion.

A heat transportation due to the axial vibration of working fluid is effective in the capillary heat pipes having the outer diameter less than 1.6 mm and an inner diameter less than 1.2 mm and, especially, in an extremely fine capillary tube of the micrometer-order range.

An efficiency of thermal transportation due to the circulation of the working fluid becomes worse due to the increase in a pressure loss in the container as the diameter of the capillary container becomes finer. On the other hand, the efficiency of the thermal transportation due to the axial directional vibration becomes improved due to the easier generation of the axial directional vibration when a mass of the liquid to which the vibration is subjected as the diameter of the container becomes smaller.

A major advantage of the micro-heat pipe in the first preferred embodiment is extreme easiness in injecting the working fluid into the container 1.

That is to say, the predetermined bi-phase working fluid is inserted under pressure through one of the terminals 1-E so as to exhaust gas in the container through the other terminal. Then, when only part of the bi-phase working fluid is exhausted, both terminals 1-E are sealed so that the full amount of the bi-phase working fluid is sealed and completed. In this case, the sealing of the other terminal may be carried out by means of a valve mounted on the other terminal. When the valve is mounted after the full amount of insertion of the working fluid, a precise weight gauge is used to measure the weight of the working fluid filled in the container and the valve is closed when an optimum amount of working fluid is filled and remains in the capillary tube. Thus, the method of filling the optimum amount of working fluid can be easily achieved. This method is free of mixing air into the container and can achieve precise adjustment of the working fluid to be filled in the container. This method can be applied to the micro-heat pipe having an inner diameter of 0.5 mm or less.

Since every junction is eliminated in the micro-heat pipe, a degree of freedom in use is large and the micro-heat pipe in the first preferred embodiment can easily be mounted on every appliance. Since no junction is present, the micro-heat pipe has reduced tendency to corrosion and failure due to incomplete connection. Consequently, reliability of the micro-heat pipe as the thermal transportation means can remarkably be improved.

Another major advantage in the structure of the micro-heat pipe in the first preferred embodiment is that a range of quantity of the filled working fluid is as wide as 10% to 95% when compared with the loop-type heat pipe disclosed the U.S. Pat. No. 4,921,041 and a difference of performance between in a bottom heat mode and a top heat mode is extremely slim over the full range of the working fluid filled amount.

This is because the energy contributing to the generation of the axial directional vibration of the nuclear boiling is effectively acted upon although the working fluid cannot sufficiently be circulated and it is well acted upon even if the quantity of working fluid is much. On the other hand, even if the quantity is less, the large amplitude of the energy causes the sufficient operation of the nuclear boiling. This means that no deterioration of performance of the micro-heat pipe occurs even if the accuracy of percentage of the filled quantity of working fluid is lowered and working operation for sealing the working fluid is facilitated.

In the case of the micro-heat pipe described above in the first preferred embodiment, metallic materials subjected to severe temperature cycles for a long term often generate particle peeling-off in metallic crystallines and generate a large quantity of metal powders. The metal powders are often deposited over bent portions of the capillary container and can block them. As a result of experimentation, when a phosphoric acid free copper was used, the heat pipe was operated at 300° C. and the closure of the bent portions began after the time of about 300 hours was passed.

When an oxygen-free copper was used, the heat pipe was operated upon at 270° C. and no change in the bended portions occurred even after 1000 hours.

The inner diameter of the micro-heat pipe in the first preferred embodiment was designed to be 1.2 mm or less. However, the inner diameter of about 4 mm may be applied if the length of one turn in the zigzag form heat pipe is short and distance between each heat receiving-/radiating portion is also short.

Second preferred embodiment

Figure 4:
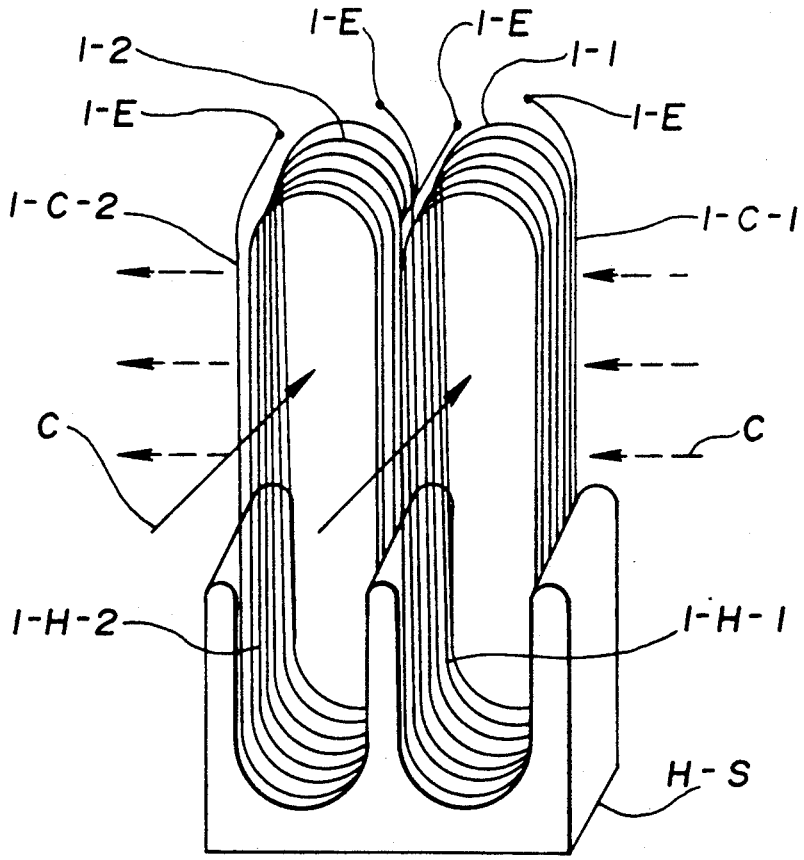
FIG. 4 is an explanatory perspective view of a micro-heat pipe in a second preferred embodiment according to the present invention.

FIG. 4 shows a second preferred embodiment of the micro-heat pipe according to the present invention.

Two elongated metallic capillary tubes each having an outer diameter of 1 mm and inner diameter of 0.7 mm were formed in oval and spiral shaped metallic capillary tubes having elongated diameters of 38 mm and shorter diameters of 18 mm and having 45 turns. Then, they were manufactured as two spiral formed and zigzag formed capillary containers having the number of turns of 45. Aluminum heat sink H-S having two semicircular grooves of radii of 9 mm and having a fin height of 13 mm and heat receiving bottom surface of 50 mm×50 mm was prepared as heat receiving means. Assembly of the capillary tubes 1-1, 1-2, as shown in FIG. 4 was carried out by soldering. After the assembly, HCFC142b having a predetermined percentage with respect to a net volume of each metallic capillary container 1-1 and 1-2 was filled into each capillary tube as the working fluid. Then, both terminals of the capillary tubes were welded and sealed so as to form a, so-called, micro-heat pipe according to the present invention. For simplicity purposes, the micro-heat pipes are shown in the diagram representations in FIG. 4.

In FIG. 4, 1-1 and 1-2 denote the capillary tube containers. 1-H-1 and 1-H-2 denote heat receiving portions, 1-C-1 and 1-C-2 denote heat radiating portions, and 1-E, 1-E denote terminal portions of the capillary tubes 1-1, 1-2. Arrows marked with C denote a cooling wind derived from cooling means.

A quantity of working liquid filled in the capillary tubes 1-1, 1-2 was changed. An amount of heat added to the heat receiving portions 1-H-1, 1-H-2 was changed to measure a temperature rise in the heat receiving portions and capability of heat transportation in the heat receiving portion was measured. The heat transportation capability was measured by comparing a heat resistance value R [°C./W] calculated as a quotient with a temperature difference Δt [°C.] between a heat sink heat-receiving surface and cooling wind temperature as a dividend, a divisor of a thermal input Q [W].

Table I and table II show results of measurements of a bottom heat mode and top heat mode at the cooling wind velocity of 3 m/s.

TABLE I

| Ther. Input | (Bottom heat mode) (a lower side of a heat receiving surface of the heat sink was held) Percentage of sealed working fluid with respect to the whole inner volume of the container | | | | | |
|---|---|---|---|---|---|---|
| | 74% | | 53% | | 36% | |
| QW | Δt °C. | R °C./W | Δt °C. | R °C./W | Δt °C. | R °C./W |
| 5 | 4.1 | 0.82 | 5.4 | 1.08 | 5.1 | 1.02 |
| 10 | 8.0 | 0.80 | 8.7 | 0.87 | 8.9 | 0.89 |
| 20 | 15.0 | 0.75 | 14.7 | 0.74 | 15.1 | 0.76 |
| 30 | 22.4 | 0.75 | 21.3 | 0.71 | 21.5 | 0.72 |
| 50 | 36.6 | 0.73 | 34.0 | 0.68 | 34.2 | 0.68 |
| 90 | 62.6 | 0.7 | 58.5 | 0.65 | 58.5 | 0.65 |

TABLE II

| Ther. Input | Top Heat Mode (the upper side of the heat receiving surface was held) Percentage of sealed working fluid with respect to the whole inner volume of container | | | | | |
|---|---|---|---|---|---|---|
| | 74% | | 53% | | 36% | |
| QW | Δt °C. | R °C./W | Δt °C. | R °C./W | Δt °C. | R °C./W |
| 5 | 5.8 | 1.16 | 5.2 | 1.04 | 5.3 | 1.06 |
| 10 | 9.5 | 0.95 | 8.6 | 0.86 | 8.9 | 0.89 |
| 20 | 16.3 | 0.82 | 15.2 | 0.76 | 14.8 | 0.74 |
| 30 | 22.7 | 0.76 | 21.7 | 0.72 | 22.1 | 0.74 |
| 50 | 37.6 | 0.75 | 33.9 | 0.67 | 34.4 | 0.69 |
| 90 | 63.8 | 0.71 | 57.8 | 0.64 | 58.0 | 0.64 |

Tables I and II indicated the following effects:

a) Such a small sized heat radiator had the performance of the thermal resistance value of 50 W and the heat radiating characteristic of 0.7° C./W or less. This meets industrial demand.

b) The working fluid having the sealed quantity of liquid was between 30% and 50%.

c) The heat pipe shown in FIG. 4 indicated superior characteristics in both top and bottom heat modes.

Third preferred embodiment

Figure 5:
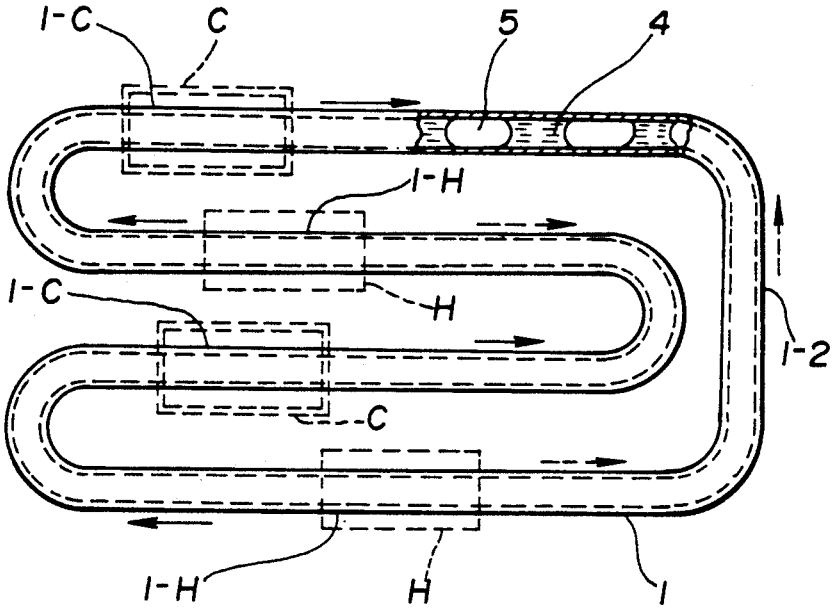
FIG. 5 is a schematic elevational view of the micro-heat pipe in a third preferred embodiment according to the present invention for explaining a theory of operation of the micro-heat pipe in the third preferred embodiment.

FIG. 5 shows a third preferred embodiment of the micro-heat pipe according to the present invention.

As shown in FIG. 5, all circulation direction limiting means as check valves as those shown in FIG. 2 are eliminated from the working fluid recirculation flow passage of the capillary tube.

However, at least one heat receiving portion 1-H and at least one heat radiating portion 1-C are installed around the capillary tube 1 in the same way as that disclosed in the U.S. Pat. No. 4,921,041.

Furthermore, the working liquid 4 is circulated with all positions of the loop being closed. This is essential in the case of the capillary tube. Both terminals of the capillary tube 1 are mutually linked so that the fluid 4 can freely be circulated in the form of loop. A predetermined part of at least one capillary tube 1 is constituted by the heat receiving portion 1-H and a predetermined part of the remaining capillary tube is constituted by the heat radiating portion 1-C. The heat receiving and heat radiating portions 1-H and 1-C are, alternatingly, disposed on the parts of the capillary tube 1. The predetermined bi-phase condensible working fluid 4 is of a predetermined quantity less than a total internal volume of the capillary tube 1. A diameter between opposing internal walls of the capillary tube is less than a maximum diameter at which the working fluid can always be circulated or moved in a closed state within the capillary tube 1.

In the structure of FIG. 5, the predetermined filled quantity of the working liquid 4 is less than the total internal volume of the capillary tube 1 in order to require an aerial-phase volume portion to generate a nucleate boiling at the heat receiving portions. In addition, the internal walls of the capillary tube 1 provide a diameter such that the working liquid 4 is closed and can be circulated or moved in order to enable the working liquid 4 to move quickly responding to a steam pressure of the nucleate boiling at the heat receiving portions 1-H. In FIG. 5, numeral 5 denotes a steam foam.

An action of the micro-heat pipe shown in FIG. 5 will be described below.

(a) Generations of pressure wave pulses and axial vibration:

The nucleate boiling of the working fluid due to a thermal absorption at each heat receiving portion 1-H causes steam foam groups to be intermittently and rapidly generated within each heat receiving portion 1-H. Each steam foam is accompanied by a rapid expansion and, thereafter, rapid condensation of the steam foams due to a cooling of adiabatic expansion. This causes the working fluid to generate pressure wave pulses which run in the loop in the axial direction of the container 1. Although one of the pulses collides against the other one of the pulses at a side opposite to the generating portion n the flow passage, their phases are deviated from each other and not canceled to each other due to compressibility of the working fluid including the compressed aerial foams. In a case where the heat receiving portions 1-H are installed respectively on the plurality of portions of the capillary tube, the pulses generated from the respective heat receiving portions are canceled to each other or amplified by each other, thereby producing large powered pulses. These pulses cause a strong axial vibration against the working fluid within the loop. The axial vibration of the working fluid generated thereby is propagated via the working fluid and compressed steam foams included in part of the working fluid.

A secondary vibration, furthermore, occurs in the loop. This secondary vibration is a forward/rearward movement of the working fluid within the tube located between the adjacent heat receiving portions. The forward/rearward movement is caused by an axial pressure application or direct pressure absorption generated by the intermittent development, expansion and condensation of resultant aerial foams. The resultant foams are generated by the multiple number of steam foams. The steam foams are generated randomly, alternatingly, or simultaneously within mutually adjacent heat receiving portions from the working fluid in the tube located between the adjacent heat receiving portions.

The secondary vibration is the vibration having the larger amplitude and stronger amplitude although the propagation speed is considerably slower than the pulses of the pressure wave generated previously. In addition, in a case where the multiple number of the heat receiving portions are installed within the loop, such vibrations as those generated from all of the heat receiving portions are partially attenuated due to mutual interference. However, the other parts thereof are amplified so that the secondary vibration is wholly amplified to provide a more powerful vibration.

(b) Generation of circulated stream of the working fluid:

As shown in FIG. 5, the working fluid 4 which is alternatingly distributed with steam foam 5 in the tube is essential in order to prevent vanishment of the pulse group of the pressure waves propagating in the working fluid, group of vibrations due to the vibrations in axial forward/rearward movement of the working fluid 4 and due to their interferences and in order to provide a compressibility for the working fluid 4. It is necessary to reduce a pressure loss of the working fluid 4 in order to facilitate the generation of vibration. In addition, it is essential for the working fluid to provide a good temperature dependent characteristic of the heat transport capability as described later. It is necessary for the working fluid in the form of circulating stream to sequentially transport the steam foams from the heat receiving portions in order to distribute the steam foams 5 and working fluid 4, alternatingly.

Then, the circulating stream in the micro-heat pipe with no check valve is generated as follows:

(1) The pressure of the steam foams generated at the heat receiving portion is reduced and constricted thereat. Hence, in a case where the capillary tube is disposed horizontally as shown in FIG. 5, the working fluid 4 flows toward one of the heat radiating portions 1-C which is nearest to the heat receiving portion 1-H so that the working fluid 4 in the loop is circulated in the direction denoted by a solid line with the arrow mark.

(2) The capillary heat pipe shown in FIG. 5 is in the bottom heat state with the lower heat receiving portion 1-H as a bottom portion and with a container linkage portion 1-2 being vertically supported. In this state, the aerial foam group 5 generated at the heat receiving portion 1-H is easiest to rise. The aerial foam 5 rises through the container linkage portion 1-2 which is of less resistance and the working fluid 4 in which the most of the aerial foam group are condensated and drops through zigzag shaped portions due to an assistance of gravity. Hence, the working fluid is circulated in the direction of broken line with arrow. That is to say, the working fluid 4 spontaneously circulates in the direction easy to obtain the assistance of gravity.

(3) The working fluid in the capillary tube spontaneously selects the direction of less resistance and is circulated in the direction and does not stagnate.

(C) Transportation of the thermal quantity:

Due to the mutual action of the aforedescribed item (a) and item (b), the working fluid 4 generates the axial vibration corresponding to the thermal quantity given by the heat receiving portion 1-H, whereby the thermal quantity is transported in the direction from one of the heat receiving portions to one of the heat radiating portions.

A Japanese Patent Application Second Publication (Examined) Heisei 2-35239 serves as a literature of theoretically analyzing the tubular passage of the working fluid which exhibits the function of thermal transportation due to the axial vibration of the working fluid filled in the tubular passage through many experiments. In the above-identified Japanese Patent Application Second Publication, a theory of operation of thermal transfer due to the axial vibration of the working fluid has been described in details. The operation of the capillary heat pipe in the third preferred embodiment according to the present invention is principally the same. The third preferred embodiment is based on the fact that the axial vibration of the working fluid in the tubular passage serves as an effective means of the thermal transportation.

The basic theory of operation in the third preferred embodiment will briefly be described as follows:

Part of the thermal transport device may be divided with the amplitude in the axial vibration as a single unit and when the fluid is vibrated at a portion having the single unit of amplitude an extremely then boundary layer of the fluid which cannot be vibrated any more can be formed between the inner surface of the tubular walls and the vibrating fluid. If a temperature difference is present between both ends of the unit length of fluid, an instantaneous temperature difference between the boundary layer and inner tube wall surface is directly transported and is stored due to thermal conduction. However, at the next moment, the lower temperature portion of the fluid is moved toward the higher temperature portion of the boundary layer and inner tubular surface so that the temperature portions are mutually and relatively changed. The higher temperature portion of the boundary layer gives the fluid the thermal quantity and the lower temperature portion absorbs the thermal quantity from the fluid. The fluid vibration causes the receipt and transmission of the thermal quantity to be rapidly repeated. A rapid thermal equalization action is generated in the fluid with the boundary layer and inner tubular surface. The whole length of the tube of the thermal transport device may be considered as an unlimited number of aggregations of the thermally equalized device in the unit of length. Therefore, the thermal transport device exhibits the function to evenly thermallize the working fluid over the whole length of the thermal transportation tube. This is because the heat pipe has the similar function as transporting the thermal quantity due to the thermal equalization action and serves as an effective thermal transportation means.

(d) Temperature dependent characteristic of the heat receiving portion of the thermal transportation capability:

The temperature dependent characteristic such that the thermal transportation capability is increased according to the magnitude of the thermal input in order for the thermal transportation means to be acted effectively. In the third preferred embodiment, a nuclear boiling becomes rapid correspondingly to the thermal input received by the heat receiving portion and the thermal transportation becomes active. The steam foams circulated in the capillary tube in which the working fluid is, alternatingly, distributed are constricted according to the rise in the saturated steam foams of the working liquid caused by the temperature rise in the heat receiving portion. The capability of propagating the pressure wave pulses and fluid vibration is increased so that the temperature dependent characteristic of the heat receiving portion of the thermal transportation capability becomes preferable.

The capillary tube in the third preferred embodiment can transport the thermal quantity from the heat receiving portion to the heat radiating portion irrespective of the elimination of the check valve(s). It is desirable to suppress the attenuation of vibrations as least as possible due to the axial reciprocation and vibration due to the pressure wave pulses since the theory of thermal transportation is based on the thermal transportation caused by the axial vibration of the working fluid. Hence, the vibration attenuation on the inner wall surface of the capillary container can become reduced as the inner wall surface becomes smoother. One of the methods of smoothing the inner tubular surface includes polishing operation using some chemical means.

A material of the capillary tube is a critical point to reduce the vibration attenuation described above. The vibration is deemed to be the internal pressure variation so that such a material as absorbing the internal variation due to the elastic deformation is required to be avoided. In addition, since a large inner pressure is applied in the inner tube due to the vibration generation and its inner pressure weight is a severe repetitive weight, such a material as having a low endurance and lack of anti-creep characteristic is not preferable. However, since the heat receiving and heat radiating portions are the thermal exchange portions, there are often the cases where the heat receiving and radiating portions inevitably need to use such a non-preferable material as copper or Aluminum which is not desirable in view of the endurance and anti-creep characteristic.

Hence, since the heat insulating portion linking at least heat receiving portion and heat radiating portion is formed of a capillary tube portion having a sufficiently thick thickness as compared with the heat receiving portion, it is desirable to be formed of a preferable metallic material having a large Young modulus and preferable anti-creep characteristic.

The heat radiation from the outer surface of the capillary tube container might reduce the thermal transportation efficiency remarkably since the thermal transportation is based on the thermal equalization action generated as a medium of the boundary layer and inner surface of the capillary tube. Hence, it is desirable for the linkage portion (heat insulating portion) between the heat receiving and heat radiating portion of the capillary tube container to be covered with a heat insulating material.

Since the above-described thermal equalization action is carried out mainly by the thermal conduction, it is desirable for a working fluid to have the high thermal conductivity. That is to say, if a liquid metal is used as the working fluid, the capillary tube in the third preferred embodiment can achieve a remarkable improvement of performance.

Since the capillary tubular heat pipe in the third preferred embodiment utilizes thermal transfer due to the axial vibration of the working fluid, the basic theory of the thermal transportation is similar to the thermal transfer device related to the Japanese Patent Application Second Publication Heisei 2-35239.

However, the capillary tubular heat pipe in the third preferred embodiment is wholly different from that disclosed in the Japanese Patent Application Second Publication Heisei 2-35239 in many respects of the structure of the thermal transfer device, vibration generation of the working fluid, and so on. Then, the capillary tube as the third preferred embodiment is novel.

It is noted that the basic theory of the third preferred embodiment is pertinent to the loop-type capillary heat pipe reciting the U.S. Pat. No. 4,921,041 and Japanese Patent Application First Publication No. Showa 63-31 84 493. However, the capillary heat pipe in the third preferred embodiment eliminates the flow direction limiting means (check valve(s)). Almost all of the preferred embodiments disclosed in the U.S. Pat. No. 4,921,041 and Japanese Patent Application First Publication Showa 63-318493 can be applied to the third preferred embodiment as modifications of the capillary tube.

The difference of the thermal transfer device disclosed in the Japanese Patent Application Second Publication No. Heisei 2-35239 from the capillary tube of the third preferred embodiment according to the present invention will be described below.

The difference of the thermal transfer device disclosed in the U.S. Pat. No. 4,921,041 and Japanese Patent Application First Publication Showa 63-318493 from the capillary tube heat pipe will also be described below.

First, essential elements of the thermal conduction device of Japanese Patent Application Second Publication Heisei 2-35239 are (1) a pair of fluid reservoirs; (2) at least one tubular passage linking these fluid reservoirs; (3) a thermal conductive fluid satisfying the tubular passage and reservoirs; and (4) axial vibration generating means. It is apparent that the thermal transfer device is not operated any more if any one of the four essential elements (1) to (4) are eliminated and deleted.

On the other hand, the essential elements of the third preferred embodiment are a) a capillary tube; and b) a working liquid having a quantity by which the working liquid is not completely filled within its inner volume of the capillary tube. The fluid reservoirs of item (1) are completely unnecessary and electrical, mechanical, or external-force utilized oscillating means are not necessary. Furthermore, a decisive difference between the heat transfer device disclosed in the JP-A2-Heisei 2-35239 and that in the third preferred embodiment lies in the structure of the working fluid and its behavior.

The JP-A2-Heisei 2-35239 describes in details the thermal transfer device which is completely different from the heat pipe. The capillary heat pipe is apparently different since the heat pipe in the third preferred embodiment is a kind of the heat pipe. The specification of the JP-A2-Heisei 2-35239 recites that the working fluid is not used in the two phases, air and liquid phases even in a case where a condensible fluid is used as the working fluid. The working fluid is used utilizing a non-compressibility in the liquid phase state. The capillary heat pipe in the third preferred embodiment is always used in the aerial and liquid phase states and is operated based on the compressibility of the two aerial and liquid phases.

In addition, the main feature of the thermal transfer device disclosed in the JP-A2-Heisei 2-35239 is that the working fluid carries out the axial vibration at a prescribed position is not accompanied with no transfer of the material. In the capillary heat pipe according to the third preferred embodiment, the fact that the working fluid is circulated in the loop is not an essential condition but the working fluid is basically circulated. Another decisive difference between thermal heat transfer devices disclosed in the JP-A2-Heisei 2-35239 and in the third preferred embodiment lies in the structure of generation of the axial vibration of the working liquid.

The working liquid disclosed in the JP-A2-Heisei 2-35239 is forcefully vibrated by means of the strong vibration generating means. A severe vibration of the vibration generating means gives vibrations unnecessary parts. The mechanical wear-out for the vibration generating means itself is generated and a reliability on a long term use of the vibration generating means becomes low. A consumption of additive large energy is involved in order to drive the vibration generating means in order to provide the transportation for the thermal quantity.

The vibration of the working fluid in the capillary heat pipe in the third preferred embodiment is not completely needed any more from an external mechanical vibration.

The capillary heat pipe in the third preferred embodiment has a novel feature that the working fluid itself serves as a generating source of the axial vibration.

That is to say, an impulse caused by the nucleate boiling of the working fluid causes the vibration to be generated, the nucleate boiling being generated by absorbing a thermal energy at each heat receiving portion. Then, the working fluid spontaneously oscillates due to the spontaneously generated nucleate boiling at any process of the thermal quantity transportation.

It is not necessary to receive an assistance of external mechanical or electrical vibration. Furthermore, an additive energy will not be consumed in order to achieve the vibration. Since the vibration is not given to the external and no consumed parts are mounted in the capillary tube as the vibration generating means, a long term use can be guaranteed.

Consequently, the heat transfer device disclosed in the JP-A2-Heisei 2-35239 and capillary heat pipe in the third preferred embodiment are completely different from each other.

Next, the difference between the capillary heat pipe disclosed in the U.S. Pat. No. 4,921,041 and JP-A1-Showa 63-318493 and the capillary heat pipe in the third preferred embodiment will be described below.

The former capillary tube is divided into a plurality of pressure chambers by means of check valves. A mutual action of a temperature difference between one of the heat receiving portions and adjacent heat radiating portion and a boiling of the working fluid at the heat receiving portion causes a respiratory action between the pressure chambers to be generated so that the working liquid is circulated. The pulse vibration of the pressure wave generated by the nucleate boiling at the heat receiving portion is absorbed into a ball valve of the check valve(s) and is converted into a vibration of the check valve(s). The vibration of the check valve furthermore provides a circulating propelling force for the working fluid. Thus, in the former heat pipe, the thermal quantity is transported due to the circulation of the working fluid in the loop. However, in the latter heat pipe, the circulation is not so strong since the capillary heat pipe in the third preferred embodiment contains no check valve and the working fluid naturally flows in the direction in which the resistance becomes lower and is of little contribution to the thermal transportation. As described above, the thermal transportation is carried out by means of the axial vibration of the working fluid generated through the nuclear boiling.

That is to say, since the structural difference in that the check valve is provided is present and theory of operation is completely different between both capillary heat pipes although the outer appearance and use conditions are the same, the heat pipe in the third preferred embodiment is of a completely different type of heat pipe.

Fourth preferred embodiment

Figure 6:
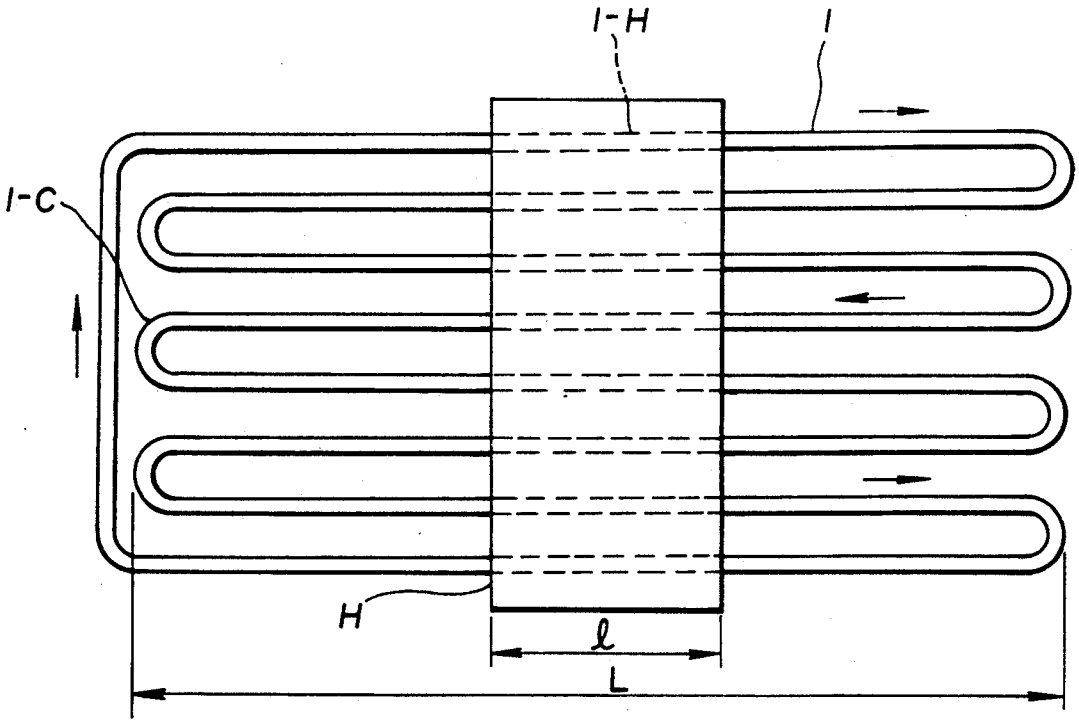
FIG. 6 is a schematic elevational view of the micro-heat pipe in a fourth preferred embodiment according to the present invention.

FIG. 6 shows a fourth preferred embodiment of the capillary container 1.

The capillary container 1 was formed repeating a multiple number of turns with both terminals of an elongated capillary tube of outer diameter 3 mm and inner diameter 2.4 mm, as shown in FIG. 6.

It is noted that the heat receiving means H included a pair of heat receiving plates made of pure copper with both surfaces of which center portions of the zigzag portions of the capillary container 1 were grasped and a heater (not shown) attached to one surface of the heat receiving portions. A width l of both of the heat receiving plates was set to 100 mm.

Figure 8:
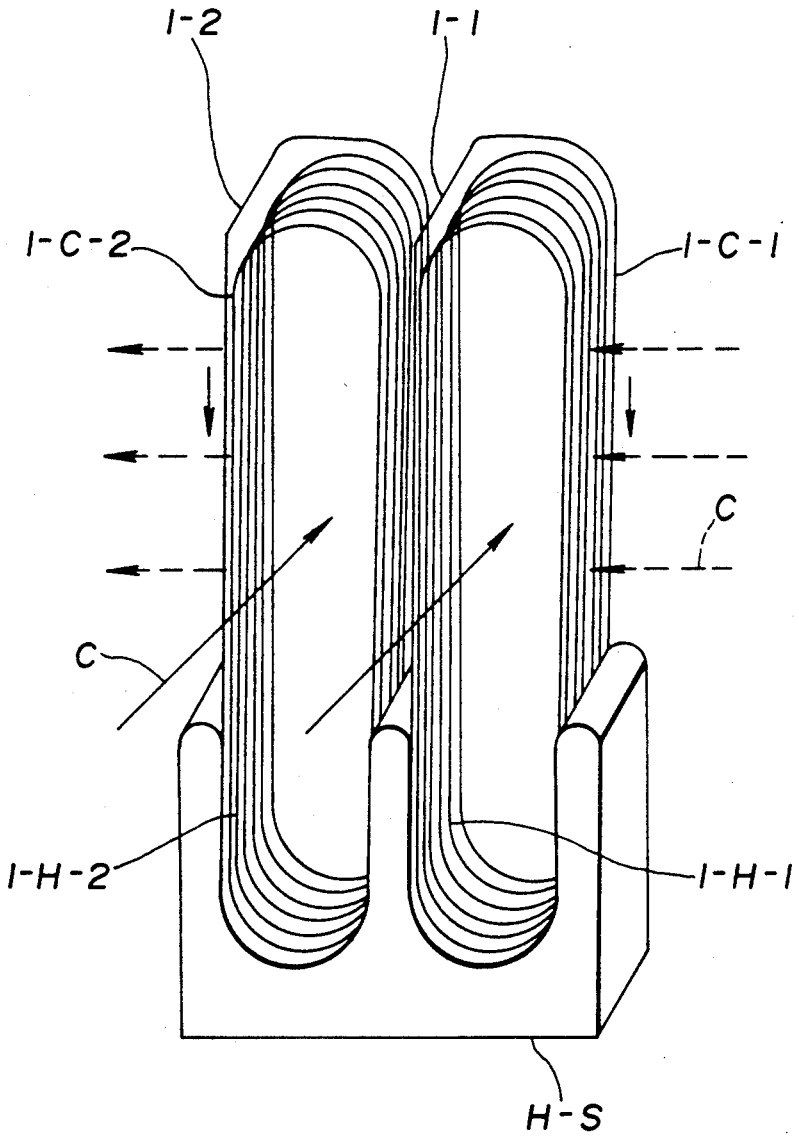
FIG. 8 is a schematic perspective view of the micro-heat pipe in a fifth preferred embodiment according to the present invention.

A length of each turn denoted by L in FIG. 8 was 460 mm. Hence, the length of the heat receiving portion 1-H was set to 100 mm. Then, the remaining turn portions except the heat receiving portion 1-H served as a heat radiating portion 1-C toward which a forced cooling by means of a wind of 4 m/s was carried out. In addition, the number of zigzag turns were 80 turns.

Next, three check valves were installed in the loop-type capillary tube 1. Then, a Fron HCFC-142b as the working fluid was filled and sealed by 40% of its internal volume and the capillary tube was constructed as in the U.S. Pat. No. 4,921,041 and JP-A1-Showa 63-318493. The disclosure of the U.S. Pat. No. 4,921,041 is herein incorporated by reference.

On the other hand, no check valve was installed in the container 1 as shown in FIG. 6 and the Fron HCFC142b as the working fluid was used and filled into the capillary tube by 70% of the internal volume. Then, heat radiating performances for both capillary containers ware compared. It is noted that measuring postures of both heat pipes in a wind-tunnel test were such that a straight tubular portion of each turn was held horizontally and the heat receiving portion was held vertically.

The measured performance was such that a temperature difference between an equilibrium temperature of a surface temperature at the part of container 1 which corresponds to the heat receiving portion 1-H held by means of the heat receiving plates corresponding to each thermal input and an inlet temperature (surrounding temperature) of the cooling wind was denoted by $\Delta t$ °C. and a thermal resistance value R (°C./W) was derived with the value of Δt °C. as the numerator and the value of thermal input as the denominator. The following table III and table IV indicated the result of measurements and the experiment actually indicated that the heat pipe in the fourth preferred embodiment had the thermal transportation capability comparable to the capillary heat pipe having the check valve(s).

TABLE III

| | With check valve | | | |
|---|---|---|---|---|
| Thermal Input (W) | Ambient Temp. (°C.) | Receiv. Por. Temp. (°C.) | Δt (°C.) | Thermal R. (°C./W) |
| 200 | 22.0 | 34.2 | 12.2 | 0.061 |
| 600 | 23.1 | 54.1 | 31.0 | 0.052 |
| 1000 | 24.2 | 71.0 | 46.8 | 0.047 |
| 2000 | 24.9 | 114.4 | 89.5 | 0.045 |

TABLE IV

| | With no check valve | | | |
|---|---|---|---|---|
| Thermal Input (W) | Ambient Temp. (°C.) | Receiv. Por. Temp. (°C.) | Δt (°C.) | Thermal R. (°C./W) |
| 200 | 23.7 | 36.6 | 11.8 | 0.059 |
| 600 | 24.8 | 66.2 | 31.4 | 0.052 |
| 1000 | 25.1 | 72.3 | 47.2 | 0.047 |
| 2000 | 25.8 | 115.2 | 89.4 | 0.045 |

Next, with the thermal input of 1000 Watts, the temperature of 72.3° C., and the thermal resistance of 0.047° C./W, the capillary tube indicated a thermally equilibrium state. In this state, one part of the container was pressed and crushed (about 90% pressed and crushed) so as to make the circulation of working fluid difficult. In this state, the equilibrium temperature at the heat receiving portion risen by 1.7° C. and the thermal resistance value was slightly worsened by 0.049° C. Furthermore, the same part was completely pressed and crushed and the circulation of the working fluid was completely stopped. The equilibrium temperature at the heat receiving portion risen by 1° C. (2.7° C. as a total) and the thermal resistance value was 0.05° C./W. This indicated that the circulation of the working fluid was a slight contribution to the temperature rise of 2.7° C. and to the thermal resistance value of 0.003° C./W and that the circulation speed was very slow. In addition, this indicated that the loop-type capillary tube in the fourth preferred embodiment was aggressively carrying out by the thermal transportation even though there was a stop state of the working fluid. The working fluid indicated that the axial vibration was more actively continued due to the compressibility caused by the effect of steam foams distributed into the flow passage and indicated that the thermal transportation function due to the axial vibration was very preferable.

Figure 7:
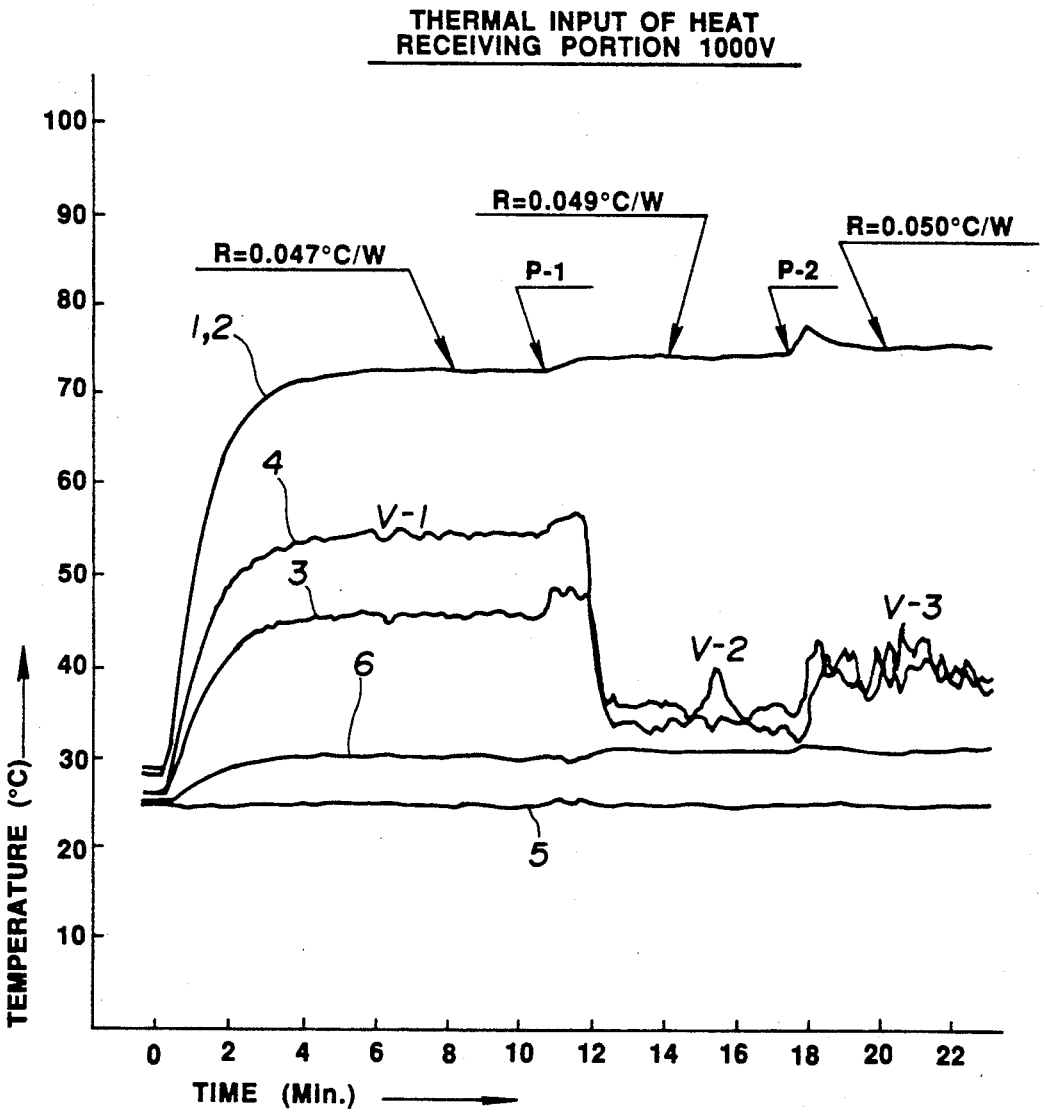
FIG. 7 is an actually recorded chart indicating a part of operating states of the micro-heat pipe in the fifth preferred embodiment shown in FIG. 6.

FIG. 7 shows the measurement data of the temperature movement in the capillary heat pipe in the fourth preferred embodiment. A longitudinal axis of FIG. 7 denotes a temperature (°C.) and lateral axis denotes a passage of time. Lines 1 and 2 (overlapped line) denote a temperature rise curved line at the thermal input of 1 KW, lines 3 and 4 denote temperature-rise curved lines of surface temperatures at a portion of the heat radiating portion near to the heat receiving portion and a portion thereof away from the heat receiving portion. Line 5 denotes an inlet air temperature of the cooled wind tunnel (ambient temperature). Line 6 denotes an air temperature of an outlet of the wind tunnel. A point P-1 denotes a first time at which a part of the loop-type container is half pressed and a point P-2 denotes a second time at which the part of the container was completely pressed and crushed. Immediately after the compete press and crush was carried out, a temperature rise was started. Temperature variations as appreciated from the lines 3 and 4 indicated the axial vibration of the working fluid in the capillary tube. Fluctuations in the circulation of the working fluid denoted by v-1 had less amplitudes with the fluctuations absorbed in the circulating flow. Amplitudes at the portions of line 4 near to the point v-2 at which the flow speed was slow. Both vibration frequencies and amplitudes became active in the vicinity to the point v-3 at which the circulation was stopped. In addition, as appreciated from the curved lines of 3 and 4 of FIG. 7, the circulation flow speed was slow due to the press and crush of the part of the loop-type capillary container and simultaneously the temperature dropped due to the effect of the cooling wind. When the circulation flow was completely stopped, the thermal exchange at the inner walls of the loop-type capillary container became more active and the thermal exchange indicated the slight temperature rise.

Fifth preferred embodiment

FIG. 8 shows a fifth preferred embodiment of the capillary heat pipe according to the present invention.

As shown in FIG. 8, two capillary heat pipe containers 1-1 and 1-2 were manufactured in the form of spiral wound zigzag fashion. Both terminals of each of the two capillary tubes 1-1 and 1-2 were linked together so as to enable flow of the working fluid therethrough. The number of turns are 4 or 5 turns. The elongated capillary tubes having outer diameters of 1 mm and inner diameter of 0.7 mm were shaped in oval spiral forms. Then, an Aluminum heat sink H-S having a fin height of 13 mm and heat receiving bottom surface of 50 mm×50 mm and having two grooves of 9 mm radius was prepared. The two terminals of the capillary heat pipes in the zigzag forms were soldered to the grooves provided on the heat sink in FIG. 8 so as to constitute a heat radiator. It is noted that the capillary containers are denoted by fine lines for convenience purposes as shown in FIG. 8. In FIG. 8, H-S denotes the heat sink used to receive heat, 1-H-1 and 1-H-2 denote heat receiving portions, 1-C-1 and 1-C-2 denote the heat radiating portions and the arrows marked C denote a cooling wind of the cooling means.

The check valves were installed in both containers and bi-phase condensible working fluid was filled by 40% of the internal volume. Then, the performance test was carried out for the capillary heat pipe disclosed in the U.S. Pat. No. 4,921,041 and JP-A1-Showa 63-318493.

Thereafter, the respective check valves were eliminated from the internal portion of the integrated capillary tube 1-1 and 1-2 and again the capillary tubes were sealed and integrated. At this time, the bi-phase working fluid was filled and sealed by 80% of the internal volume. The performance was measured after the capillary heat pipe in the fifth preferred embodiment was prepared as shown in FIG. 8.

All measuring speeds of winds were at 3 m/s. The measurement form was a bottom heat mode and top heat mode. The measurement result was such that the performance of the capillary tube was superior to that of the counterpart disclosed in the U.S. Pat. No. 4,921,041 in any measuring mode. Furthermore, the performance of the latter capillary tube in the top heat mode was reduced but the performance of the former capillary tube in the top heat mode was not changed with respect to that in the bottom heat mode. The temperature dependence of the heat receiving portion of the thermal transportation capacity with respect to each thermal input was preferable. The following tables V and VI show the measurement data.

TABLE V

| Thermal Input (W) | Ambient Temp. (°C.) | Heat Rec. Temp. (°C.) | Δt (°C.) | Ther. R (°C./W) |
|---|---|---|---|---|
| | Measurement condition Bottom Heat Mode Wind speed 3 m/s. | | | |
| | A) Check valve present | | | |
| 10 | 21.2 | 30.3 | 9.1 | 0.91 |
| 30 | 21.0 | 45.0 | 24.0 | 0.80 |
| 50 | 20.3 | 59.6 | 39.3 | 0.79 |
| 90 | 20.2 | 85.6 | 65.4 | 0.73 |
| | B) No Check Valve | | | |
| 10 | 20.9 | 29.1 | 8.2 | 0.82 |
| 30 | 21.4 | 45.1 | 23.7 | 0.79 |
| 50 | 21.1 | 60.1 | 39.0 | 0.78 |
| 90 | 21.2 | 86.9 | 65.7 | 0.73 |

TABLE VI

| Thermal Input (W) | Ambient Temp. (°C.) | Rec. Por. Temp. (°C.) | Δt (°C.) | Thermal Res. °C./W |
|---|---|---|---|---|
| | Measurement Condition Top Heat Mode Wind Speed 3 m/s. | | | |
| | WITH Check valve | | | |
| 10 | 23.4 | 32.9 | 9.5 | 0.95 |
| 30 | 23.1 | 48.0 | 24.9 | 0.83 |
| 50 | 23.1 | 64.3 | 41.2 | 0.82 |
| 90 | 23.1 | 93.4 | 70.3 | 0.78 |
| | No check valve | | | |
| 10 | 22.5 | 31.3 | 8.8 | 0.88 |
| 30 | 22.5 | 45.7 | 23.2 | 0.77 |
| 50 | 22.7 | 61.3 | 38.6 | 0.77 |
| 90 | 23.1 | 86.1 | 66.0 | 0.73 |

Sixth preferred embodiment

Figure 9:
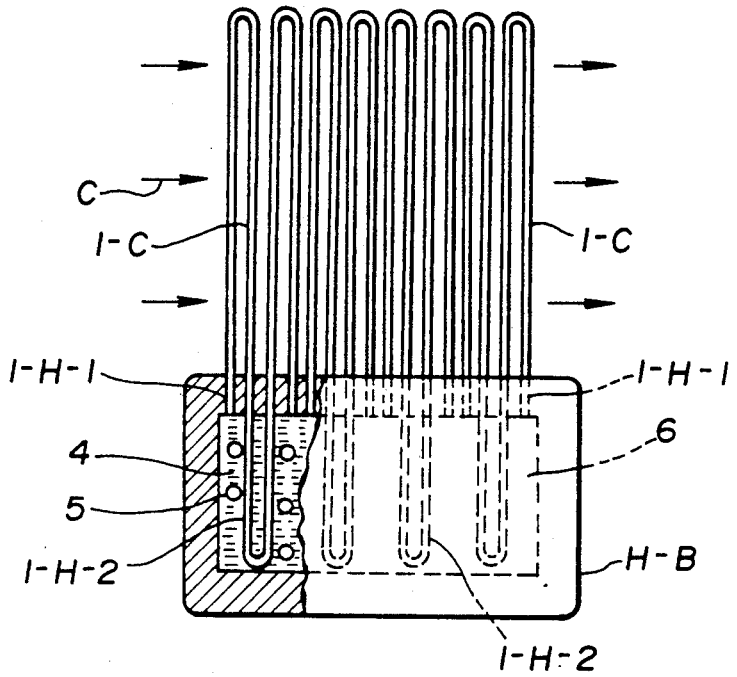
FIG. 9 is a schematic partially sectioned elevational view of the micro-heat pipe in a sixth preferred embodiment according to the present invention.

FIG. 9 shows a sixth preferred embodiment of the capillary heat pipe.

Since the capillary heat pipe is constituted by the capillary container 1, the quantity and the number of steam foams generated by the nuclear boiling become often insufficient in a case where the length of the heat receiving portions cannot be extended. In this case, the axial vibration of the working fluid becomes inactive and the performance would be reduced. In such a case, it is recommended that a predetermined group in a heat receiving portion group of the capillary tube be introduced into a common steam generating chamber into which the terminals of the containers are open.

In FIG. 9, H-B denotes a heat receiving block constituted by heat receiving means into which the steam generating chamber 6 is installed.

In the steam generating chamber 6, a group 1-H-1 which is a part of the groups of the heat receiving portions of the capillary tube 1 is introduced into the steam generating chamber 6 and open so that the working liquid and steam foams are enabled to flow therethrough. The remaining group 1-H-2 is introduced into the steam generating chamber 6 but not open. The group of the heat receiving portion 1-H-2 absorbs directly the thermal quantity from the generated steam to receive the heat quantity and to produce the nucleate boiling. A mutual action together with the pressure wave in the axial vibration introduced from an open end of the heat receiving portion group 1-H-2 helps a slow working fluid circulation. Upon the heat radiation, the steam foam group is distributed into the working fluid of part of the capillary container 1-C in which the liquid phase becomes rich so as to facilitate the generation of the axial vibration. Sufficient numbers and quantities generated by the steam generating chamber 6 are introduced from an opening end of the heat receiving group 1-H-1.

Seventh preferred embodiment

Figure 10:
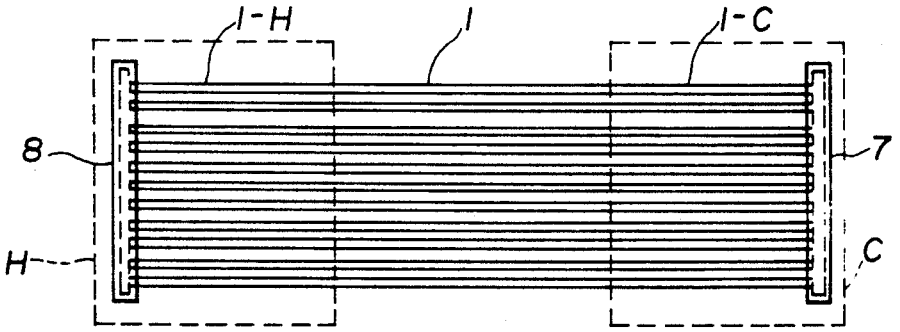
FIG. 10 is a schematic elevational view of the micro-heat pipe in a seventh preferred embodiment according to the present invention.

FIG. 10 shows a seventh preferred embodiment of the capillary heat pipe.

In the capillary heat pipe which transports the heat quantity from one of the heat receiving portions to one of the heat radiating portions when the working fluid flows in the capillary tube 1 as a circulating stream, the zigzag turns cause the multiple number of straight tubular portions to be gathered and to be closely juxtaposed to each other to form a large capacity of heat receiving and heat radiating portions. In this case, it is impossible to make the radius of curvature of each turn below a predetermined limit. Many difficulties occur in which a density of juxtapositions are increased. Such a limit as of the radius of curvature includes a first limit such that an abrupt turn is generated due to an abrupt rise in the pressure loss of the internal tube. Such rises as in the pressure loss are accumulated in the multiple number of turns and the capillary heat pipe became impossible to operate. The limit described above includes a second limit such that a local press and crush would occur due to the flexing as the radius of curvature becomes reduced in the case of thin capillary tube. Minimum radius of curvature of the capillary tube outer diameter of 1 mm and inner diameter of 0.7 mm includes 2 mm of the inner diameter and outer diameter of about 3 mm. The limit of the radius of curvature of the capillary tube of the outer diameter 3 mm and inner diameter of 2.4 mm is 3 mm in outer diameter and about 6 mm of inner diameter.

On the other hand, in the case of the capillary heat pipe in the seventh preferred embodiment, the transportation of the thermal quantity is caused by the pressure wave pulse propagated in the working fluid and axial vibration of the fluid. These do not exhibit the large attenuation of the vibration even if the abrupt turn is carried out in a case when the amplitude is small. Hence, the problem would be solved if the technological processing limit is overcome.

As shown in FIG. 10, the capillary container 1 includes the zigzag capillary container of the multiple turns. the curved tubular portions in the turn group are integrally formed as a common inner pressure tube or inner pressure vessels 7 and 8. The terminal groups of the turn group are open in the inner vessels 7 and 8. In FIG. 10, H denotes the heat receiving means and C denotes the cooling means. 1-H denotes the heat receiving portion of the capillary container. 1-C denotes the heat radiating portion of the capillary container. The working fluid in the inner pressure tube or inner pressure vessel 7, 8 propagates the pressure wave and axial directional vibration pressure in all directions on the basis of a Pascal's principle toward the opening ends of the respective turns of the capillary tube 1. The inner pressure tubes or inner pressure vessels 7 and 8 serve as the curved tubular portions having the extremely small radii of curvatures. Hence, the turns of the capillary container 1 can be minuaturerised and extremely closely juxtaposed to each other.

Eighth preferred embodiment

Figure 11:
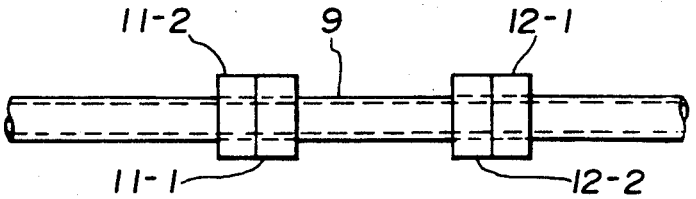
FIG. 11(A) is a schematic elevational view of the micro-heat pipe in an eighth preferred embodiment according to the present invention.
FIG. 11(B) is a schematic elevational view of the prior art heat pipe having check valve for the comparison with FIG. 11(A).
Figure 11:
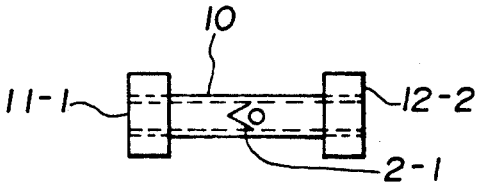

FIG. 11(A) shows an eighth preferred embodiment of the capillary heat pipe according to the present invention.

The capillary heat pipe in the eighth preferred embodiment and the counterpart shown in FIG. 11(B) disclosed in the U.S. Pat. No. 4,921,041 and JP-A1-Showa 63-31 84 93 are wholly different from each other in their operating principles. However, the external structures are all the same and the reduction to practice is almost the same. In a case where these features are effectively utilized, there are superior points and inferior points. After the manufactures and design are completed, a frequency of generating the modifications may become high.

The major distinctive features of the capillary tubes are such that the filling of the working fluid and increase and decrease of the filled quantity can easily be reduced into practice after the completion of the applied product and at the lay-out sites of the applied product. In a case where the former is modified from the former to the latter, the check valves may easily be attached into the capillary tube. In a case where the latter is modified from the latter to the former, the check valves may only be eliminated. The cutting and connection of the capillary container are kinds of easy operations. The mounting of the check valves and elimination operations can easily be reduced into practice. In addition, if such mounting operations are predicted, the parts in which the check valves are eliminated from the capillary containers or in which the mounting is predicted are cut with a predetermined distance provided. Flare junctures such as 11-2 and 12-1 of FIGS. 11(A) and 11(B), female and male junctures of auto couplings are, respectively, mounted on both cut terminals. Two capillary containers in which the female and male flare junctures corresponding to the male and female autocouplings 11-1 and 12-2 are prepared. One of the two capillary containers 9 is used as the connection container for merely adjusting the length thereof. The other one is the two kinds of the capillary containers 10 with the check valve 2-1. If these are exchanged and removed and attached, the capillary heat pipe 1 in which the check valve 2-1 is removably attached. The former and latter capillary heat pipes are changeable and modifiable. In this case, especially if the latter heat pipe is exchanged to the former heat pipe in the eighth preferred embodiment, a minute adjustment of the sealed quantity of liquid is almost unnecessary and therefore the capillary tube can easily be achieved.

This is because in the capillary heat pipe in the eighth preferred embodiment, the pressure wave and vibration wave are preferably propagated without change even though the liquid is sealed over a wide adjustable range of 65% to 95% of the full quantity of the inner volume.

As described herein above, since the micro-heat pipe according to the present invention includes: a hermetically sealed capillary container having a vacuum sealed predetermined compressible working fluid of a predetermined quantity, the hermetically sealed capillary container being formed of an elongated metallic fine tube having a sufficiently small diameter to enable movement of the bi-phase compressible working fluid in a state where the working fluid is always filled and closed in the capillary container due to its surface tension; a plurality of predetermined parts of the capillary container serving as heat receiving portions and a plurality of predetermined parts of the capillary container serving as heat radiating portions, the heat radiating portions being located between the heat receiving portions, the micro-heat pipe having the capillary container of the inner diameter less than 1.2 mm can easily be manufactured and the small-sized heat radiator having a high performance can easily be achieved. Since the high performance of the micro-heat pipe according to the present invention cannot be reduced in the top heat mode as compared with other various types of heat pipes, a small-sized heat radiator to which the present invention is applied can stably and positively be mounted in appliances where the change of posture frequently occurs. In addition, since the filled liquid quantity is extremely less, the micro-heat pipe can endure a strength against centrifugal force and impulse. Furthermore, since no welding portion is present in the container, a small-sized heat radiator providing a high reliability can be constructed.

In addition, although it is conventionally impossible to completely guarantee a long life due to the inevitable use of the vibrating mechanism such as the check valve, the capillary container according to the present invention can eliminate all of consumed parts in the container and of auxiliary mechanisms outside of the container since the new adoption of theory of operation. Therefore, the long term use of the capillary container according to the present invention can be guaranteed. The heat pipe according to the present invention can have a near perfect reliability.

Since it is indispensable for an interim inspection during the manufacture since a manufacturing error of the check valve occurs and variation of the performance is generated in the previously proposed loop-type capillary heat pipe, the heat pipe according to the present invention can relieve the above-described problem although the inspection of air tightness after the check valve is mounted. The improvement of reliability can remarkably be achieved.

The capillary heat pipe according to the present invention has an extremely simple structure. Novel manufacturing equipment is not needed and the heat pipe according to the present invention can immediately be mass-produced.

The heat pipe according to the present invention can directly be applied to all of the preferred embodiments. The heat pipe according to the present invention can easily be manufactured with elimination of the check valve and re-sealing of the working fluid.

The heat pipe according to the present invention has various effects other than those described above.

Finally, it is noted that the capillary heat pipe generally referred to as the micro-heat pipe has the inner diameter from 3 mm to a micrometer order range.

It will fully be appreciated by those skilled in the art that the foregoing description has been made in terms of the preferred embodiments and various changes and modifications may be made without departing from the scope of the present invention which is to be defined by the appended claims.

What is claimed is:

1. A structure of a heat pipe, comprising:

a) a metallic elongate tube of continuous capillary dimension;

b) a predetermined bi-phase condensative working fluid having a predetermined quantity less than an internal volume of the metallic elongate tube, the metallic elongate tube having a small inner diameter sufficient to allow the bi-phase condensible working fluid to move in a flow passage of the metallic elongate tube in a state always filled and closed in the metallic tube container due to surface tension;

c) at least one heat receiving portion located on a first predetermined part of the metallic elongate tube; and d) at least one heat radiating portion located on a second predetermined part of the metallic elongate tube, both heat receiving portion and heat radiating portion being alternatively disposed on the metallic tube.

2. A structure of the heat pipe as set forth in claim 1, wherein both terminals of the metallic elongate tube are connected to each other to form a continuous capillary loop-type flow passage.

3. A structure of the heat pipe as set forth in claim 2, wherein almost all parts of the loop-type capillary container are formed in zigzag fashions multiple turns or in spiral fashions of multiple turns and the heat receiving portion and heat radiating portion are mutually plural and wherein almost all heat receiving and heat radiating portions are located on predetermined parts of the metallic elongate tube of respective turns of almost all parts of zigzag forms or spiral forms.

4. A structure of the heat pipe as set forth in claim 3, wherein an internal surface of the metallic elongate tube is smoothly polished.

5. A structure of the heat pipe as set forth in claim 4, wherein a heat insulating portion linking one of the heat receiving portions and adjacent one of the heat radiating portions in the metallic elongate tube is formed of the metallic elongate tube having a sufficiently thick thickness as compared with that at the heat radiating and heat receiving portions or of the metallic tube made of a metallic material having a high Young's modulus and high anti-creep characteristic.

6. A structure of the heat pipe as set forth in claim 5, wherein the heat insulating portion is coated with an insulating material.

7. A structure of the heat pipe as set forth in claim 6, wherein the bi-phase condensible working fluid is made of a fluid metal.

8. A structure of the heat pipe as set forth in claim 7, wherein a predetermined heat receiving portions group from among a plurality of heat receiving portion groups is introduced into a common steam generating chamber, these terminals thereof being open from the common steam generating chamber.

9. A structure of the heat pipe as set forth in claim 8, wherein the metallic elongate tube is formed having a multiple number of turns, bent portions of the multiple turned portions being formed as a common internal pressure valve or as a common internal pressure vessel, the terminal groups of the turns being open to the internal pressure valve or to the internal pressure vessel.

10. A structure of the heat pipe as set forth in claim 1, wherein both terminals of the metallic elongate tube are hermetically sealed.

11. A structure of the heat pipe as set forth in claim 10, wherein the metallic elongate tube is formed in a zigzag fashion having a multiple number of turns and wherein a predetermined part of each turned portion is constituted by the heat receiving portion and another predetermined part thereof is constituted by the radiating portion.

12. A structure of the heat pipe as set forth in claim 11, wherein the elongate tube has an inner diameter equal to or less than 1.2 millimeters and the metallic elongate tube is made of an oxygen-free copper.

13. A structure of a heat pipe according to claim 1, wherein the metallic elongate tube has a continuous inside diameter of less than about 4.0 mm, whereby nucleate boiling of the working fluid at the heat receiving portion causes axial vibration of the working fluid resulting in thermal transfer from the heat receiving portion to the heat radiating portion.

14. A structure of a heat pipe according to claim 1, wherein the metallic elongate tube has a continuous inside diameter of less than about 1.2 mm, whereby nucleate boiling of the working fluid at the heat receiving portion causes axial vibration of the working fluid resulting in thermal transfer from the heat receiving portion to the heat radiating portion.

15. A structure of a heat pipe, comprising:

a) a metallic elongate tube of continuous capillary dimension;

b) a predetermined bi-phase condensible working fluid having a predetermined quantity less than an internal volume of the metallic elongate tube, the metallic elongate tube having a small inner diameter sufficient to allow the bi-phase condensible working fluid to move in a flow passage of the metallic elongate tube in a state always filled and closed in the metallic tube container due to surface tension;

c) at least one heat receiving portion located on a first predetermined part of the metallic elongate tube; and d) at least one heat radiating portion located on a second predetermined part of the metallic elongate tube, both heat receiving portion and heat radiating portion being alternatively disposed on the metallic tube, whereby nucleate boiling of the working fluid at the heat receiving portion causes axial vibration of the working fluid resulting in thermal transfer from the heat receiving portion to the heat radiating portion without the need of check valves to control circulation of working fluid.

* * * * *

UNITED STATES PATENT AND TRADEMARK OFFICE

CERTIFICATE OF CORRECTION

PATENT NO. : 5,219,020

DATED : June 15, 1993

INVENTOR(S) : Hisateru Akachi

It is certified that error appears in the above-identified patent and that said Letters Patent is hereby corrected as shown below:

On the cover page, the Assignee should read --Actronics Kabushiki Kaisha, a part interest--

Claim 11, column 22, line 11 --heat-- should be inserted after "the".

Signed and Sealed this

Thirtieth Day of August, 1994

*Attest:*

*Attesting Officer*

BRUCE LEHMAN

*Commissioner of Patents and Trademarks*